US005244416A

United States Patent [19]

Masnou

[11] Patent Number: 5,244,416

[45] Date of Patent: Sep. 14, 1993

[54] MULTICONTACT CONNECTOR PROTECTED AGAINST INTERFERENCE

[75] Inventor: Christophe Masnou, Lyon, France

[73] Assignee: Radiall, Rosny-Sous-Bois, France

[21] Appl. No.: 909,318

[22] Filed: Jul. 6, 1992

[30] Foreign Application Priority Data

Jul. 10, 1991 [FR] France ..... 91 08683

[51] Int. Cl.[5] ..... H01R 13/66

[52] U.S. Cl. ..... 439/620

[58] Field of Search ..... 439/620.95; 333/182

[56] References Cited

U.S. PATENT DOCUMENTS 4,582,385 4/1986 Couper et al. ..... 439/620 X
4,707,049 11/1987 Gliha ..... 439/620
4,729,743 3/1988 Farrar et al. ..... 439/620 X

FOREIGN PATENT DOCUMENTS 0211508 2/1987 European Pat. Off. .
9014707 11/1990 PCT Int'l Appl. .

*Primary Examiner*—Eugene F. Desmond
*Attorney, Agent, or Firm*—Schweitzer Cornman & Gross

[57] ABSTRACT

The invention relates to a multicontact connector protected against interference comprising a conductive casing, a plurality of contacts housed in the said casing and a plurality of clipping diodes each associated with a contact, each of the diodes having a substantially cylindrical shape with two disc-shaped electrodes arranged on either side of a cylindrical active part.

The clipping diodes (11) are arranged in the casing (1, 2) of the connector with their longitudinal axis perpendicular to the axis of the contacts (3), one of the electrodes of each diode being brazed directly onto the side of the corresponding contact and the other electrode being connected electrically to at least one metal layer (7) forming an earth plane produced on a printed card (6) arranged transversely in the casing and containing a plurality of metallized through-holes (9) which are insulated from the said metal layer(s), for passage of the contacts (3).

7 Claims, 2 Drawing Sheets

MULTICONTACT CONNECTOR PROTECTED AGAINST INTERFERENCE

BACKGROUND OF THE INVENTION

The present invention relates to a multicontact connector against interference, of the type comprising a conductive casing, a plurality of contacts housed in the said casing, and a plurality of clipping diodes each associated with a contact, each of the diodes being connected on the one hand to the corresponding contact and on the other hand to a metal layer forming an earth plane and connected electrically to the casing of the connector.

Electronic equipment on board aircraft require increasingly to be protected against interference which can impair their functioning, or even destroy them, with all the conceivable dramatic consequences.

Among this interference is found in particular the nuclear and luminous electromagnetic pulses generated by a nuclear explosion and lightning respectively, as well as electrostatic discharges.

This interference acts directly at equipment level, either by conduction at the level of the incoming and outgoing wiring of the equipment, or by induction.

A first step in the protection consists in housing the equipment in a metal environment, forming a Faraday cage, which protects it from part of the interference.

The problem arises at the level of the input/output connections of the equipment with the outside.

Indeed, the connectors are so many windows open to the outside and through which interference is liable to engender disturbances.

For the abovementioned interference, the disturbances appear in the form of transient discharges of voltage or of current, depending on whether the impedance of the line is high or low.

To eliminate such interference, it has been proposed to associate with the contacts of the connectors semiconductor diodes, in particular of Transil or Transzorb type, designed to clip overvoltages and dissipate large energies under transient conditions.

This involves avalanche diodes which possess very short response times and energy absorption capabilities such that they make it possible to do away with the majority of transients generated by interference related to lightning, to a nuclear explosion or of electrostatic origin.

Such diodes, which take a substantially cylindrical shape with two disc-shaped electrodes arranged on either side of a cylindrical active central part, are known.

Such diodes have relatively sizeable dimensions as compared with those of the contacts of the multicontact connectors, and owing to their dimensions have not hitherto been able to be implemented satisfactorily with connectors with a high density of contacts in which the separation between contacts can be less than the diameter of the diodes.

SUMMARY OF THE PRESENT INVENTION

The present invention proposes to produce a multicontact connector protected against interference, in which it is possible by an advantageous arrangement of the diodes, to make maximum use of the space available between the contacts in the casing of the connector and thus to produce connectors with a high density of contacts.

The connector according to the invention is characterised essentially in that the clipping diodes are arranged in the casing of the connector with their longitudinal axis perpendicular to the axis of the contacts, one of the electrodes of each diode being brazed directly onto the side of the corresponding contact and the other electrode being connected electrically to at least one metal layer forming an earth plane produced on a printed card arranged transversely in the casing and containing a plurality of metallised through-holes which are insulated from the said metal layer(s), for passage of the contacts.

By virtue of the fact that each of the diodes is placed directly adjacent to the corresponding contact, inductive line effects which would be liable to affect the response time of the diodes are reduced.

Moreover, insofar as the longitudinal axis of the diodes is perpendicular to the axis of the contacts, the proportions of the diodes between the contacts are determined by their thickness which is in general notably smaller than their diameter, so that it is possible according to the invention to use diodes of large dimensions.

In an advantageous embodiment of the invention, the electrode of each diode, other than that fixed to the contact, is connected electrically to the said metal layer(s) produced on the printed card by a conductive lug fixed by brazing via a first end to the said other electrode and via a second end to the said printed card.

The printed card contains, preferably, a second plurality of metallised through-holes connected electrically with the metal layer(s), forming earth planes, and into which the second ends of the said conductive lugs of the diodes are fixed by brazing.

Particularly advantageously, the conductive lugs of the diodes associated with two neighbouring contacts have unequal-length tails so that the two neighbouring diodes can be arranged whilst being offset in the axial direction of the contacts so as to produce a staggered layout of diodes.

Preferably, the conductive lugs of the diodes associated with two neighbouring contacts are inserted into the same hole of the said second plurality of through-holes and are fixed therein by brazing.

The conductive lugs contain, in a particular embodiment, at their first end a substantially disc-shaped portion whose face is fixed by brazing onto the outer face of the said other electrode of each diode. The disc-shaped portion has, in particular, a surface area substantially equal to that of the corresponding electrode of the diode, so as to permit a connection by brazing onto a sizeable segment.

For the purpose of better explaining the invention, an embodiment thereof will now be described, by way of entirely non-limiting example, whilst referring to the attached drawings which:

DETAILED DESCRIPTION OF THE INVENTION

Figure 2:
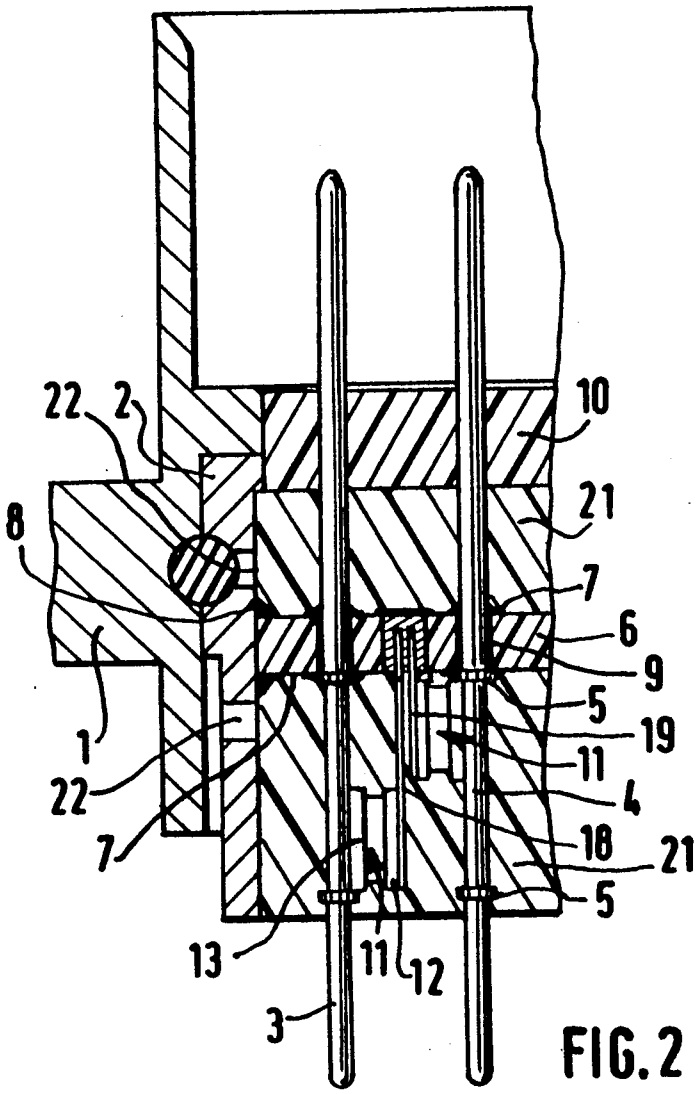
FIG. 2 is a fragmentary longitudinal sectional view of this connector.

The connector according to the invention comprises a conductive metal outer casing which, in the example illustrated, comprises an outer casing element 1 and an inner casing element 2, assembled via pins.

The connector comprises a plurality of contacts 3 each having a part 4 of reduced diameter formed between collars 5.

The connector contains a printed card 6 arranged transversely with respect to the contacts and having on its two faces in the example illustrated, a metal layer, in particular of copper, forming an earth plane 7, the card 6 being fixed to the inner casing element 2 by brazing beads 8 ensuring an effective earthing of the metal layers 7 of the card.

Figure 3:
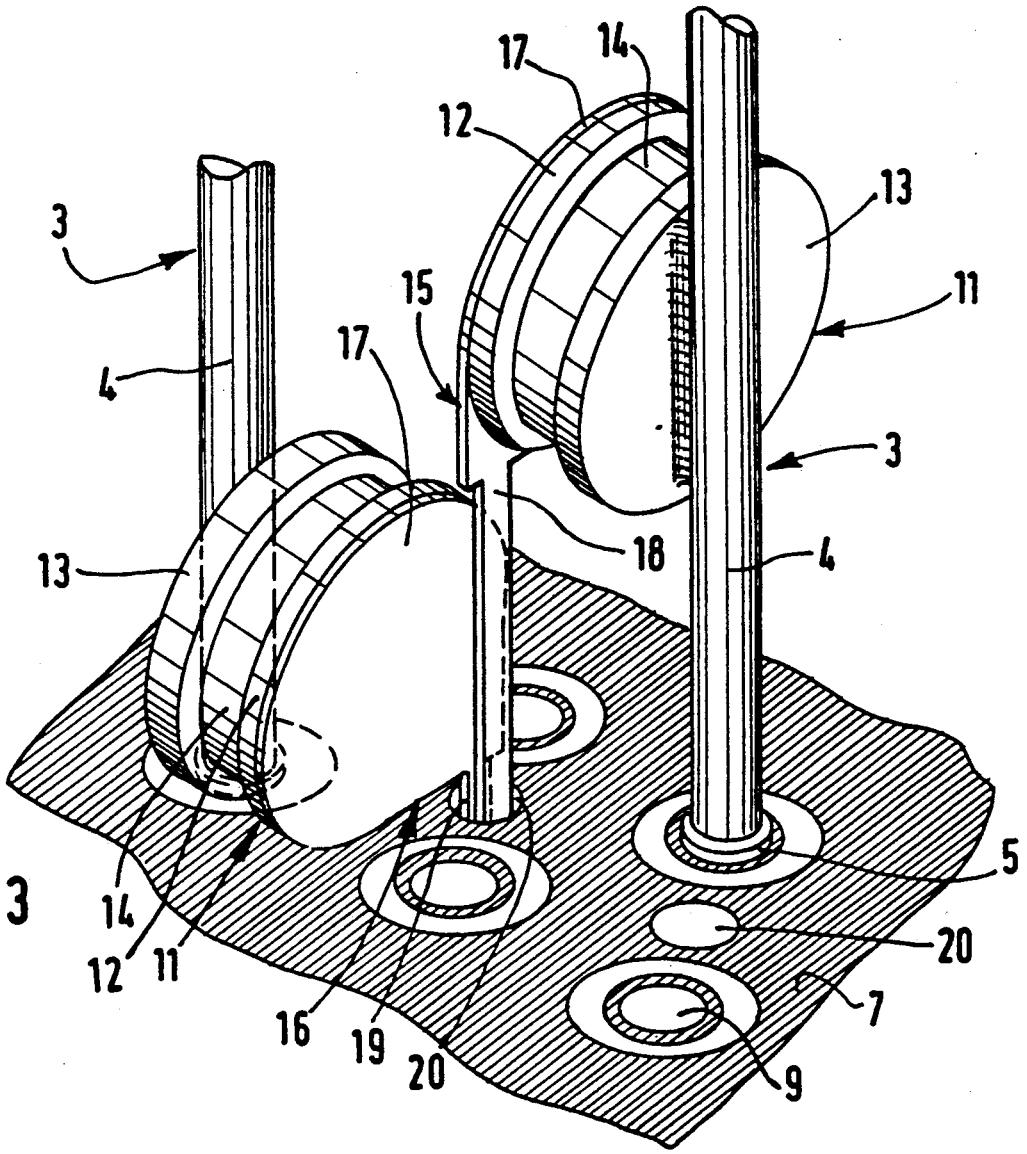
FIG. 3 is a perspective view illustrating the mounting of the clipping diodes in the connector of FIGS. 1 and 2.

For passage and retention of the contacts 3, the card 6 contains a first plurality of through-holes 9 which are metallised but which, as will best be seen in FIG. 3, are electrically insulated from the metal layers 7.

For their positioning in the front part of the connector, the contacts 3 pass through a moulded insulating block 10 mounted in the inner casing element 2.

According to the invention, a plurality of clipping diodes 11 is provided, the structure of which is best seen in FIG. 3.

Each diode 11 has the shape of a cylindrical pulley with two disc-shaped electrodes 12 and 13 between which there is a cylindrical portion 14 containing the active part of the diode.

The electrodes 13 of each diode are fixed by brazing onto the side of the corresponding contact 3 in its part 4 of reduced diameter. Thus the axis of each diode is perpendicular to the axis of the corresponding contact.

Onto the outer faces of the opposing electrodes 12, lugs 15, and 16 respectively are brazed, each having a disc-shaped end part 17 of surface area corresponding substantially to that of the electrode, this part 17 being prolonged by a lengthened tail 18 and respectively 19, the tail 18 of the lugs 15 being substantially longer than the tail 19 of the lugs 16.

For passage of the tails 18 and 19 of two adjacent diodes, there is provided in the card 6 a second plurality of metallised holes 20 into which the ends of the tails are fixed by brazing.

Figure 1:
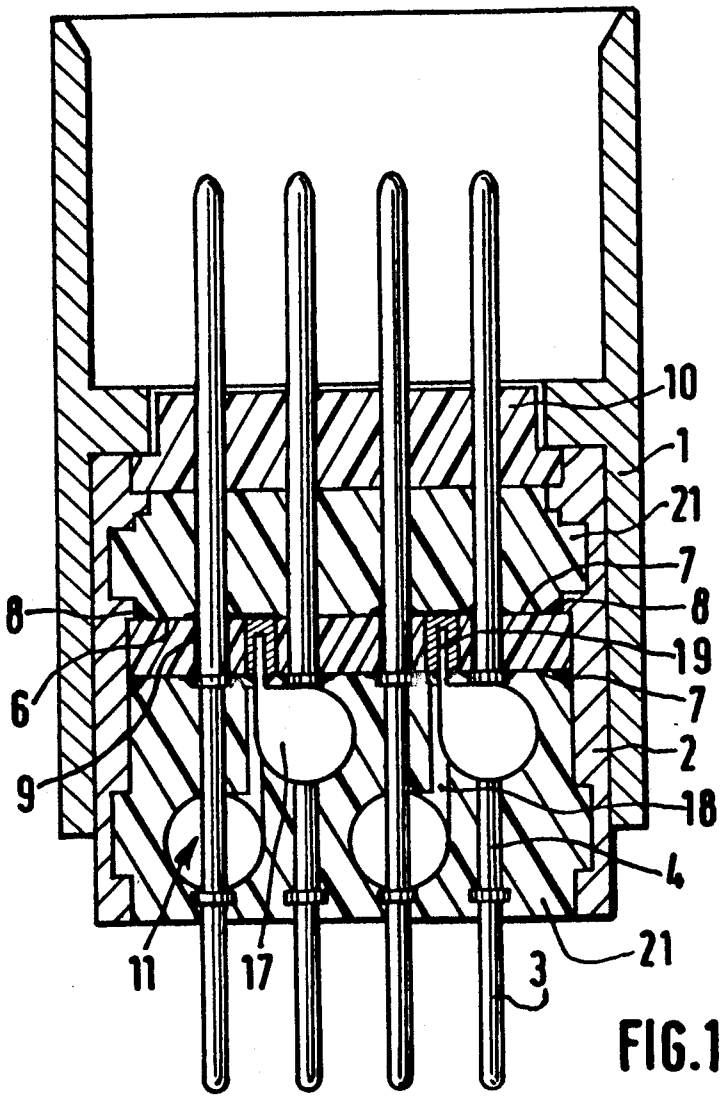
FIG. 1 is a transverse sectional view of a connector according to the invention.

As is seen in the drawing, owing to the unequal lengths of the tails of the lugs 15 and 16 it is possible to mount the diodes associated with two adjacent contacts in a manner offset in the axial direction of the contacts producing, as is seen in particular in FIG. 1, a staggered layout of the diodes enabling optimal use to be made of the space between the contacts.

A way of fabricating the connector according to the invention will be described below.

The diodes 11 are fixed by brazing onto the contacts 3, the fixing being effected directly onto the outer face of the electrodes 13 of the diodes, and the lugs 15 and 16 respectively are brazed onto the other electrodes 12 of the diodes. The brazings are done at about 220° C.

One contact out of two is equipped with a diode with a lug 15 having a long tail 18 and one contact out of two is equipped with a diode with a lug 16 having a short tail 19.

Each contact furnished with its diode, the latter provided with its lug for connection to earth, is then mounted in the printed card 6, by inserting the ends of the tails of the earth lugs into the holes 20 provided to this effect in the printed card. The card is itself mounted in the inner casing element 2 which is produced in a material which can be brazed at a relatively low temperature, for example 180° C., such as a light, copper-containing, tin-containing alloy, and all the metallised holes 9 and 20 of the card are filled with brazing paste, for example tin/lead based, at the same time as brazing paste beads 8 are put in place on the outer edge of the card for connection with the inner casing element.

The contacts are positioned with the aid of the moulded insulator 10 and all the brazings are then effected at the same time, in particular at 180° C. by passage through an infrared oven or in the vapour-phase.

The free spaces between the contacts in the inner casing element 2 on either side of the printed card 6 are next filled in with a coating resin 21 injected through the holes 22 made in the inner casing element.

The assembly produced is next put in place in the outer casing element and the casing elements are assembled via pins.

The diodes 11 put in place can have the same values of voltage or of power.

It is possible however, depending on the application, to use in the same connector diodes with different values of voltage or of power, it being possible for example for these values to vary from 5 to 170 volts in quiescent voltage and from 500 to 1500 W in peak power.

Although the invention has been described in connection with a particular embodiment, it is of course clear that it is in no way limited thereto and that diverse variants and modifications can be made thereto without in any way exceeding either its scope or its spirit.

I claim:

1. A multicontact connector protected against interference comprising a conductive casing, a plurality of contacts housed in the said casing and a plurality of clipping diodes each associated with a contact, each of the diodes having a substantially cylindrical shape with two disc-shaped electrodes arranged on either side of a cylindrical active part and being connected on the one hand to the corresponding contact and on the other hand to a metal layer forming an earth plane and connected electrically to the casing of the connector, characterized in that the clipping diodes (11) are arranged in the casing (1, 2) of the connector with their longitudinal axis perpendicular to the axis of the contacts (3), one of the electrodes (13) of each diode being brazed directly onto the side of the corresponding contact and the other electrode (12) being connected electrically to at least one metal layer (7) forming an earth plane produced on a printed card (6) arranged transversely in the casing and containing a plurality of metallized through-holes (9) which are insulated from the said metal layer(s), for passage of the contacts (3); the electrode (12) of each diode, other than that electrode (13) fixed to the contact, is connected electrically to said metal layer(s) produced on a printed card by a conductive lug (15, 16) fixed by brazing via a first end (17) to the said other electrode (12) and via a second end to the said printed card.

2. Connector according to claim 1, characterised in that the printed card contains a second plurality of metallised through-holes (20) connected electrically with the metal layer(s) (7), forming earth planes, and into which the second ends of the said conductive lugs of the diodes are fixed by brazing.

3. Connector according to claim 2, characterised in that the conductive lugs (15, 16) of the diodes associated with two neighbouring contacts have unequal-lengths tails (18, 19) so that the two neighbouring diodes can be arranged whilst being offset in the axial direction of the contacts so as to produce a staggered layout of diodes.

4. Connector according to claim 3, characterised in that the conductive lugs of the diodes associated with two neighbouring contacts are inserted into the same hole (20) of the said second plurality of through-holes and are fixed therein by brazing.

5. Connector according to claim 1, characterised in that the conductive lugs (15, 16) contain at their first end a substantially disc-shaped portion (17) whose face is fixed by brazing onto the outer face of the said other electrode (12) of each diode.

6. Connector according to claim 5, characterised in that the said disc-shaped portion (17) has a surface area substantially equal to that of the electrode (12, 13) onto which it is fixed.

7. Connector according to claim 1, characterised in that each contact (3) has a part (4) of reduced diameter, onto which the electrode (13) of the corresponding diode is brazed.

* * * * *